US005967474A

United States Patent [19]

doCanto et al.

[11] Patent Number: 5,967,474

[45] Date of Patent: Oct. 19, 1999

[54] HOLDING DEVICE

[75] Inventors: Fabricio doCanto; Norbert Koop, both of Hamburg, Germany

[73] Assignee: Beiersdorf AG, Hamburg, Germany

[21] Appl. No.: 09/028,837

[22] Filed: Feb. 24, 1998

[30] Foreign Application Priority Data

Mar. 1, 1997 [DE] Germany ..... 197 08 364

[51] Int. Cl.[6] ..... A47G 1/17

[52] U.S. Cl. ..... 248/205.3; 248/308; 248/294.1; 428/343

[58] Field of Search ..... 248/205.3, 308, 248/294.1, 301, 304; 428/343, 40.1

[56] References Cited

U.S. PATENT DOCUMENTS

| | | | |
|---|---|---|---|
| 4,024,312 | 5/1977 | Korpman | 428/343 |
| 4,181,553 | 1/1980 | Hogg | 156/211 |
| 4,221,354 | 9/1980 | Kemphers | 248/308 X |
| 4,312,455 | 1/1982 | Weber | 248/308 X |
| 5,491,012 | 2/1996 | Luhmann et al. | 428/40 |
| 5,507,464 | 4/1996 | Hamerski et al. | 248/683 |
| 5,626,931 | 5/1997 | Luhnman | 428/40.1 |
| 5,626,932 | 5/1997 | Luhmann et al. | 428/40.1 |
| 5,725,923 | 3/1998 | Luhmann | 428/40 |

FOREIGN PATENT DOCUMENTS

| | | |
|---|---|---|
| 3331016 | 10/1984 | Germany . |
| 4333872 | 4/1995 | Germany . |
| 19511288 | 10/1996 | Germany . |
| WO92/11332 | 9/1992 | WIPO . |
| WO92/11333 | 9/1992 | WIPO . |
| WO94/21157 | 9/1994 | WIPO . |
| WO95/06691 | 3/1995 | WIPO . |

OTHER PUBLICATIONS

DE 4431914 Pat abst
DE 4428587 Pat Abst
DE 4339604 Pat Abst
DE 4222849 Pat Abst
DE 19511288 Pat Abst
De 3331016 Pat Abst
DE 4333872 Pat Abst.

*Primary Examiner*—Daniel Zirker
*Attorney, Agent, or Firm*—Sprung Kramer Schaefer & Briscoe

[57] ABSTRACT

Holding device having a baseplate, which for bonding with an adhesive strip which releases on pulling is designed such that a grip tab of the adhesive strip projects beyond the baseplate, and having a front functional part which covers the baseplate and also the adhesive-strip grip tab which projects beyond this baseplate, characterized in that the baseplate (2) and the front functional part (4) are designed in one piece and joined by way of a hinge (3), the front functional part (4) having a holding device (8).

10 Claims, 2 Drawing Sheets

HOLDING DEVICE

Figure 1:
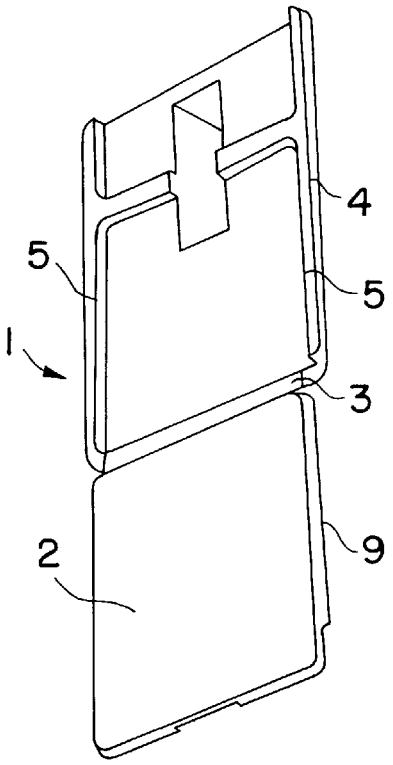

The invention relates to a holding device which by means of adhesive strips which release on pulling is reversibly bondable and reusable, possibly with a new such adhesive strip.

Adhesive strips which release on pulling are commercialised as "tesa power-strips" by Beiersdorf AG and also are described by numerous patents, such as DE 33 31 016 B1, DE 42 22 849 B1, DE 43 39 604 B1, DE 44 28 587 B1 and DE 44 31 914 B1. In addition, U.S. Pat. No. 4,024,312, WO92/11332, WO92/11333 and WO95/06691 describe adhesive strips of this kind. Such adhesive strips are pulled out of the bond in the direction of the bond joint, in a way comparable with the opening of a preserving jar.

In addition, hooks or similar fastening systems for use together with such adhesive strips are commercialised as "tesa power-strips mit Haken" [with hooks] or else "tesa power-strips Systemhaken" by Beiersdorf AG, described inter alia by DE 43 33 872 B1 and DE 195 11 288 B1. In addition, however, WO94/21157 describes hooks of this kind.

Problems with hooks and the like of the prior art are, on the one hand, the visual concealment of the grip tab, which for the subsequent pulling must project beyond the device, and, on the other, a protection of this grip tab against manipulation or damage, including in particular damage by UV light, since as soon as the grip tab has been damaged and tears on subsequent pulling, all is lost, adherends and customer. And ultimately, a multi-component embodiment as taught by the prior art is disadvantageous if a part has been lost or fell down, in the course, for instance, of mounting.

The object of the invention was to remedy this situation and, in particular, to provide a hook or the like which does not have the disadvantages of the prior art, or at least not to the same extent.

The invention relates accordingly to a holding device, especially a hook, as characterized in detail in the claims. The embodiments according to the subclaims are preferred.

Advantages of the holding devices of the invention are, in particular, that it is easy to produce without expensive tools—in particular, no moving tool parts are required. In addition, however, there is ease of use without the need for explanation by means of accompanying slips, etc. since the single-component product to a certain extent itself shows a user how he or she should fold it together around its hinge. And, finally, the production of particularly small hooks and other fastening systems, such as curtain hooks, cable clips, etc., since there is no need for free space on the reverse side of the hook as is the case, for instance, with the commercially obtainable two-part system having a base plug part.

The holding device of the invention together with its baseplate is preferably stuck onto the adhesive strip which has already been bonded to the wall etc. In this arrangement, the grip tab of the adhesive strip remains projecting and accessible. The functional part is then folded over the baseplate and grip tab so that both are hidden behind it. Here, there is preferably notch-type locking of notch devices on the functional part with notch devices on the baseplate. Conversely, for subsequent removal, the functional part is first of all folded open and held, as a result of which the grip tab becomes accessible and, by pulling on the said tab in the direction of the bond plane, the bond is released. Here, the holding of the functional part prevents the adhesive strip being pressed too strongly in the course of removal and hence possibly tearing, or avoids the need to apply an unduly high stripping force to achieve this. Thus the holding device is removed undamaged (from the undamaged wall or the like) and can be used again.

The invention will now be elucidated with reference to examples and drawings, without wishing to restrict it unnecessarily thereby.

Figure 2:
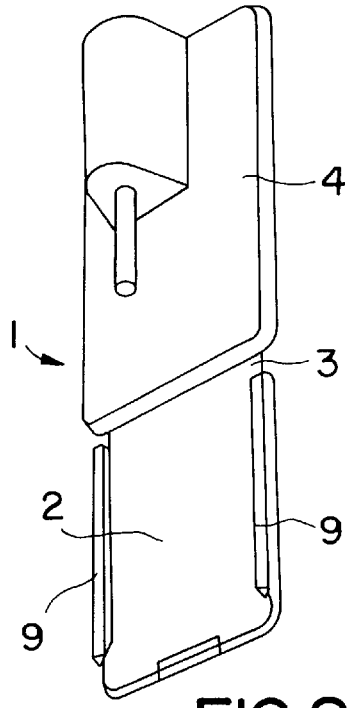
Figure 3:
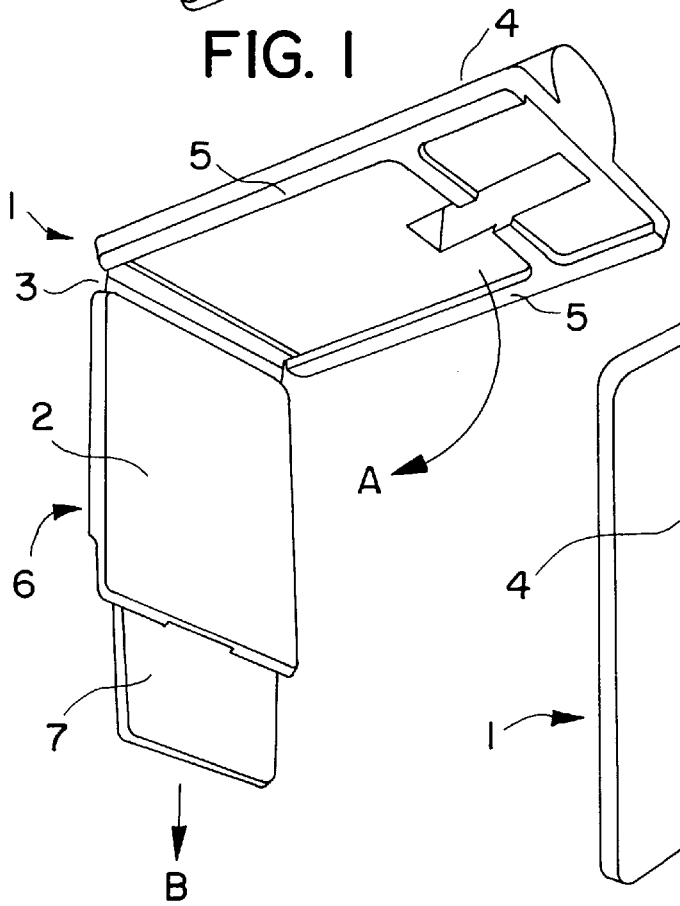
Figure 4:
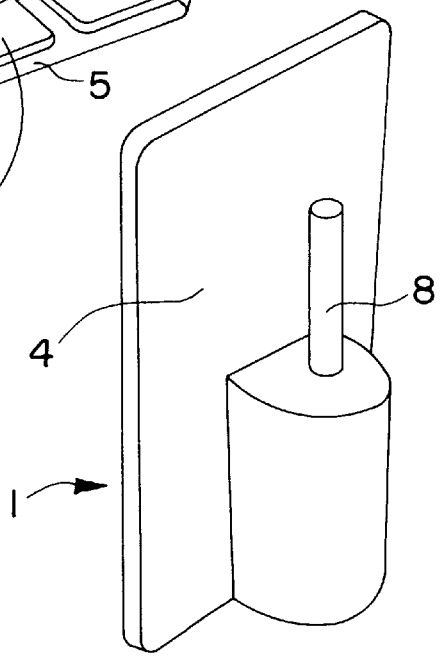
Figure 5:
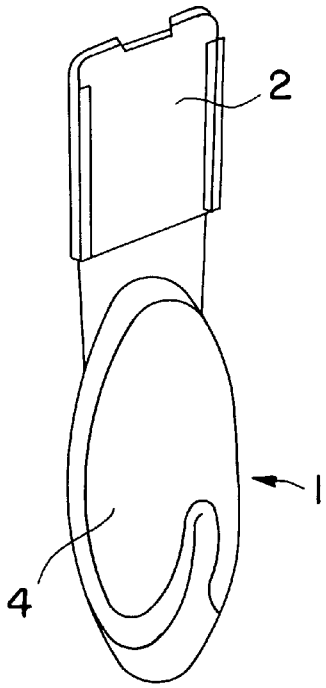
Figure 6:
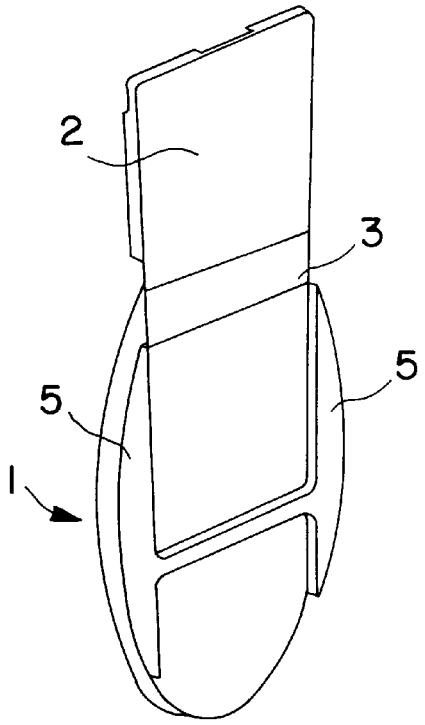
Figure 7:
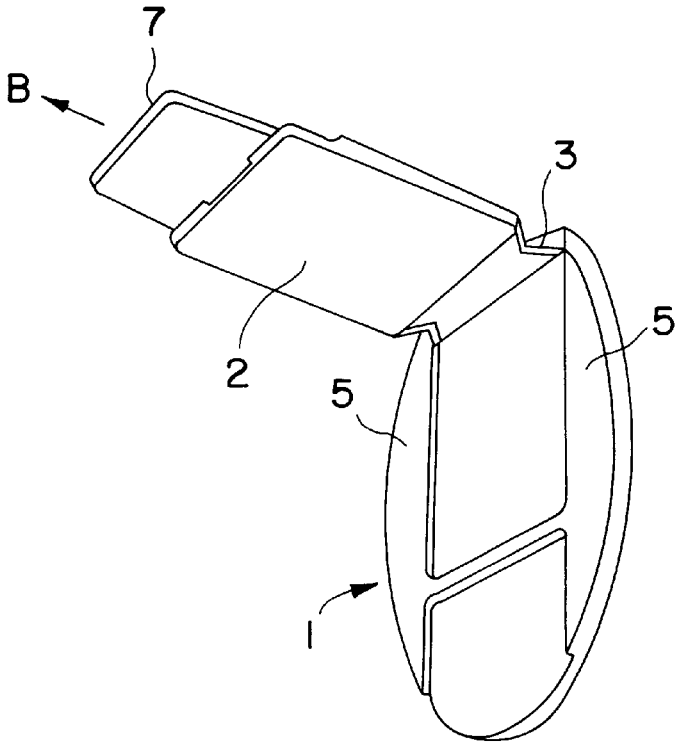
Figure 8:
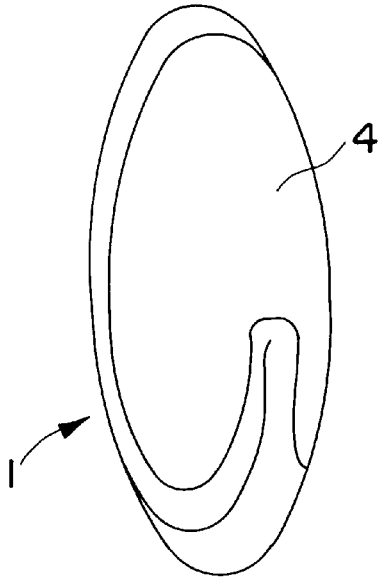

In the drawings:

FIG. 1 shows a folded-open holding device, obliquely from behind,

FIG. 2 shows a view as in FIG. 1 but now obliquely from the front relative to the baseplate, FIG. 3 shows a half-open holding device, obliquely from the front and with an adhesive strip on the back, and FIG. 4 shows a holding device folded shut, obliquely from the front, FIG. 5 shows a circular or oval holding device obliquely from the front, in the folded-open state, FIG. 6 shows a holding device as in FIG. 5, seen obliquely from the rear, FIG. 7 shows a further holding device as in FIG. 5, in the half-open state and obliquely from the rear, and FIG. 8 shows a holding device as in FIG. 7, folded shut and seen obliquely from the front.

The holding device 1 has a baseplate 2 which is connected by a hinge 3, designed as a film hinge, to the front functional part 4. By way of the hinge 3 the functional part 4 can be folded over the baseplate 2 such (arrow A in FIG. 3) that the functional part 4 conceals the baseplate 2, and its edge regions 5 surround the said baseplate and an adhesive strip 6 which, together with its grip tab 7, is to be bonded behind the baseplate 2. In the folded-shut state of FIG. 4, therefore, the baseplate 2 and also the adhesive strip 6 with its grip tabs 7 disappear. By pulling on the grip tab 7 in the direction of the arrow B (FIG. 3 and FIG. 7) the adhesive bond can be separated again without damage or residue.

On its front face, the functional part 4 has a holding device 8 designed as a hook, a bracket or a press-stud.

On the reverse side of the baseplate 2, at the side, there are spacers 9. These spacers laterally delimit the adhesive strip 6. Their height is less than the thickness of the adhesive strip 6, and in particular is about ⅔–⅓ of the adhesive strip 6.

In general, a holding device of the invention consists, in particular, of a flexible plastic suitable for injection moulding, and especially of Styrolux.

We claim:

1. A device for holding an object, said device comprising:

a) a baseplate, which is intended to be attached to a substrate by an adhesive strip having a grip tab in such a way that the grip tab projects beyond an end of said baseplate;

b) a covering hingably connected to one end of said baseplate, and adapted to fold against said baseplate and thereby conceal said baseplate, any adhesive strip attached to said baseplate and any grip tab of said adhesive strip; and c) a holder on said covering for holding an object.

2. A device for holding an object according to claim 1, wherein said covering and said baseplate are hingably connected by a film hinge.

3. A device for holding an object according to claim 1, said device consisting of one piece of injection molded plastic.

4. A device for holding an object according to claim 1, wherein said holder comprises a hook, bracket or press-stud.

5. A device for holding an object according to claim 1, wherein said covering has notch devices, said baseplate has notch devices corresponding to the notch devices of said covering and said notch devices of said covering are releasably lockable with said corresponding notch devices of said baseplate.

6. A device for holding an object according to claim 1, wherein said baseplate has spacers protruding from said baseplate on either side of an area where the adhesion strip attaches, said spacers being of a height less than the thickness of the adhesion strip.

7. A device for holding an object according to claim 6, wherein the height of said spacers is ⅔ to ⅓ the thickness of an adhesive strip attached to said baseplate.

8. A device for holding an object according to claim 6, wherein said covering has edge regions which, when the covering is folded against the baseplate, surround and visually conceal the baseplate, any adhesive strip attached to said baseplate and any grip tabs of said adhesive strip.

9. A device for holding an object according to claim 1 having an adhesive strip attached behind said baseplate.

10. A method for attaching an object to a substrate, said method comprising:

a) providing a device according to any one of claims 1–9;

b) attaching the baseplate of said device to said substrate via an adhesive strip having a grip tab which protrudes from an end of said baseplate once said baseplate is attached to said substrate;

c) folding said covering against said baseplate to conceal said baseplate, said adhesive strip, and said grip tabs; and d) attaching an object to said holder.

* * * * *